US007988522B2

(12) United States Patent
Chen

(10) Patent No.: US 7,988,522 B2
(45) Date of Patent: Aug. 2, 2011

(54) ELECTRONIC DINOSAUR TOY

(75) Inventor: Ga-Lane Chen, Santa Clara, CA (US)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 493 days.

(21) Appl. No.: 12/135,819

(22) Filed: Jun. 9, 2008

(65) Prior Publication Data

US 2009/0104844 A1 Apr. 23, 2009

(30) Foreign Application Priority Data

Oct. 19, 2007 (CN) ..... 2007 1 0202155

(51) Int. Cl.
*A63H 3/46* (2006.01)

(52) U.S. Cl. ..... 446/376; 446/29; 446/297; 446/298; 446/300; 446/302; 901/1; 901/2; 901/46; 318/568.12; 318/568.16; 700/245; 700/249

(58) Field of Classification Search ..... 446/29, 446/297, 302, 376, 298, 300; 700/245, 249; 901/1, 2, 46; 318/568.12, 568.16
See application file for complete search history.

(56) References Cited

U.S. PATENT DOCUMENTS 4,289,307 A * 9/1981 Marshall et al. ..... 472/98
4,451,911 A * 5/1984 Klose et al. ..... 369/30.02
4,654,659 A * 3/1987 Kubo ..... 340/13.29
4,957,444 A * 9/1990 Armen ..... 434/247
5,052,680 A * 10/1991 Malewicki et al. ..... 472/137
5,074,820 A * 12/1991 Nakayama ..... 446/29
5,141,464 A * 8/1992 Stern et al. ..... 446/338
5,306,199 A * 4/1994 Locricchio ..... 446/177
5,378,189 A * 1/1995 Chiu ..... 446/353
5,498,193 A * 3/1996 Locricchio ..... 446/361
6,036,572 A * 3/2000 Sze ..... 446/177
6,176,759 B1 * 1/2001 Trageser ..... 446/272
6,210,249 B1 * 4/2001 Stadlbauer ..... 446/330
6,322,420 B1 * 11/2001 Daniellian ..... 446/300
6,442,450 B1 * 8/2002 Inoue et al. ..... 700/245
6,462,498 B1 * 10/2002 Filo ..... 318/568.12
6,484,068 B1 * 11/2002 Yamamoto et al. ..... 700/245
6,505,098 B1 * 1/2003 Sakamoto et al. ..... 700/245
6,509,707 B2 * 1/2003 Yamashita et al. ..... 318/567
6,565,407 B1 * 5/2003 Woolington et al. ..... 446/175
6,620,024 B2 * 9/2003 Choi ..... 446/485
6,652,351 B1 * 11/2003 Rehkemper et al. ..... 446/354
6,652,353 B1 * 11/2003 Lund et al. ..... 446/356
6,667,593 B2 * 12/2003 Inoue et al. ..... 318/568.2
6,672,934 B2 * 1/2004 Hornsby et al. ..... 446/300
6,682,390 B2 * 1/2004 Saito ..... 446/268
6,684,127 B2 * 1/2004 Fujita et al. ..... 700/245
6,685,530 B1 * 2/2004 Rehkemper et al. ..... 446/175
6,695,672 B1 * 2/2004 Rehkemper et al. ..... 446/298

(Continued)

*Primary Examiner* — Gene Kim
*Assistant Examiner* — Alexander Niconovich
(74) *Attorney, Agent, or Firm* — Andrew C. Cheng

(57) ABSTRACT

An exemplary electronic dinosaur toy includes a body, a neck, four legs, a tail, a head, four first actuators, and four pressure sensors. The neck, the legs and the tail are connected to the body. The head is connected to a distal end of the neck. The four first actuators are arranged inside the respective legs and configured for driving the corresponding leg to move. The four pressure sensors are arranged at distal ends of the respective legs, and configured for sensing a variation of a pressure applied to the leg and outputting a feedback signal. Thereby, the first actuator adjusts a movement of the leg based on the feedback signal.

13 Claims, 1 Drawing Sheet

U.S. PATENT DOCUMENTS 6,736,694 B2 * 5/2004 Hornsby et al. ..... 446/356
6,764,373 B1 * 7/2004 Osawa et al. ..... 446/175
6,772,121 B1 * 8/2004 Kaneko ..... 704/270
6,959,166 B1 * 10/2005 Gabai et al. ..... 434/308
6,997,773 B1 * 2/2006 Dubois et al. ..... 446/175
7,040,951 B2 * 5/2006 Hornsby et al. ..... 446/454
7,061,200 B2 * 6/2006 Iribe ..... 318/568.16
7,068,004 B2 * 6/2006 Tsurumi ..... 318/568.12
7,076,331 B1 * 7/2006 Nagatsuka et al. ..... 700/245
7,117,190 B2 * 10/2006 Sabe et al. ..... 706/45
7,118,443 B2 * 10/2006 Marine et al. ..... 446/268
7,251,606 B2 * 7/2007 Horinaka et al. ..... 704/272
7,330,775 B2 * 2/2008 Orita et al. ..... 700/245
7,363,108 B2 * 4/2008 Noda et al. ..... 700/245
7,364,489 B1 * 4/2008 Iaconis et al. ..... 446/330
7,411,332 B2 * 8/2008 Kornbluh et al. ..... 310/311
7,431,629 B1 * 10/2008 Maddocks et al. ..... 446/376
7,442,107 B1 * 10/2008 Ueda et al. ..... 446/175
7,507,139 B1 * 3/2009 Maddocks et al. ..... 446/282
7,515,992 B2 * 4/2009 Sawada et al. ..... 700/245
7,695,341 B1 * 4/2010 Maddocks et al. ..... 446/330
7,722,429 B2 * 5/2010 Campbell ..... 446/376
7,731,559 B1 * 6/2010 Maddocks ..... 446/297
7,747,350 B2 * 6/2010 Matsuzaki et al. ..... 700/245
2001/0049248 A1 * 12/2001 Choi ..... 446/356
2002/0016128 A1 * 2/2002 Saito ..... 446/268
2002/0089297 A1 * 7/2002 Filo ..... 318/568.12
2003/0182122 A1 * 9/2003 Horinaka et al. ..... 704/270
2003/0187653 A1 * 10/2003 Okubo et al. ..... 704/270
2004/0054531 A1 * 3/2004 Asano ..... 704/231
2004/0133311 A1 * 7/2004 Park et al. ..... 700/245
2004/0152394 A1 * 8/2004 Marine et al. ..... 446/175
2004/0198169 A1 * 10/2004 Hornsby et al. ..... 446/454
2004/0219861 A1 * 11/2004 Madhani et al. ..... 446/355
2005/0085157 A1 * 4/2005 Dahlquist et al. ..... 446/268
2006/0014470 A1 * 1/2006 Takahashi et al. ..... 446/330
2006/0041332 A1 * 2/2006 Sabe et al. ..... 700/245
2006/0143006 A1 * 6/2006 Asano ..... 704/238
2006/0290241 A1 * 12/2006 Kornbluh et al. ..... 310/800
2007/0021031 A1 * 1/2007 Madhani et al. ..... 446/377
2007/0021032 A1 * 1/2007 Tye et al. ..... 446/377
2007/0060020 A1 * 3/2007 Civettini et al. ..... 446/484
2007/0127704 A1 * 6/2007 Marti et al. ..... 379/373.01
2007/0128979 A1 * 6/2007 Shackelford et al. ..... 446/484
2007/0159779 A1 * 7/2007 Chang ..... 361/683
2007/0161323 A1 * 7/2007 Fischer ..... 446/330
2007/0270074 A1 * 11/2007 Aochi et al. ..... 446/175
2007/0285843 A1 * 12/2007 Tran ..... 360/245.9
2008/0166945 A1 * 7/2008 Cheng et al. ..... 446/268
2008/0167751 A1 * 7/2008 Cheng et al. ..... 700/249
2008/0177421 A1 * 7/2008 Cheng et al. ..... 700/245
2009/0055019 A1 * 2/2009 Stiehl et al. ..... 700/249
2009/0137323 A1 * 5/2009 Fiegener et al. ..... 463/43
2009/0163111 A1 * 6/2009 Garbos et al. ..... 446/298
2010/0043765 A1 * 2/2010 Lang ..... 124/25.6

* cited by examiner

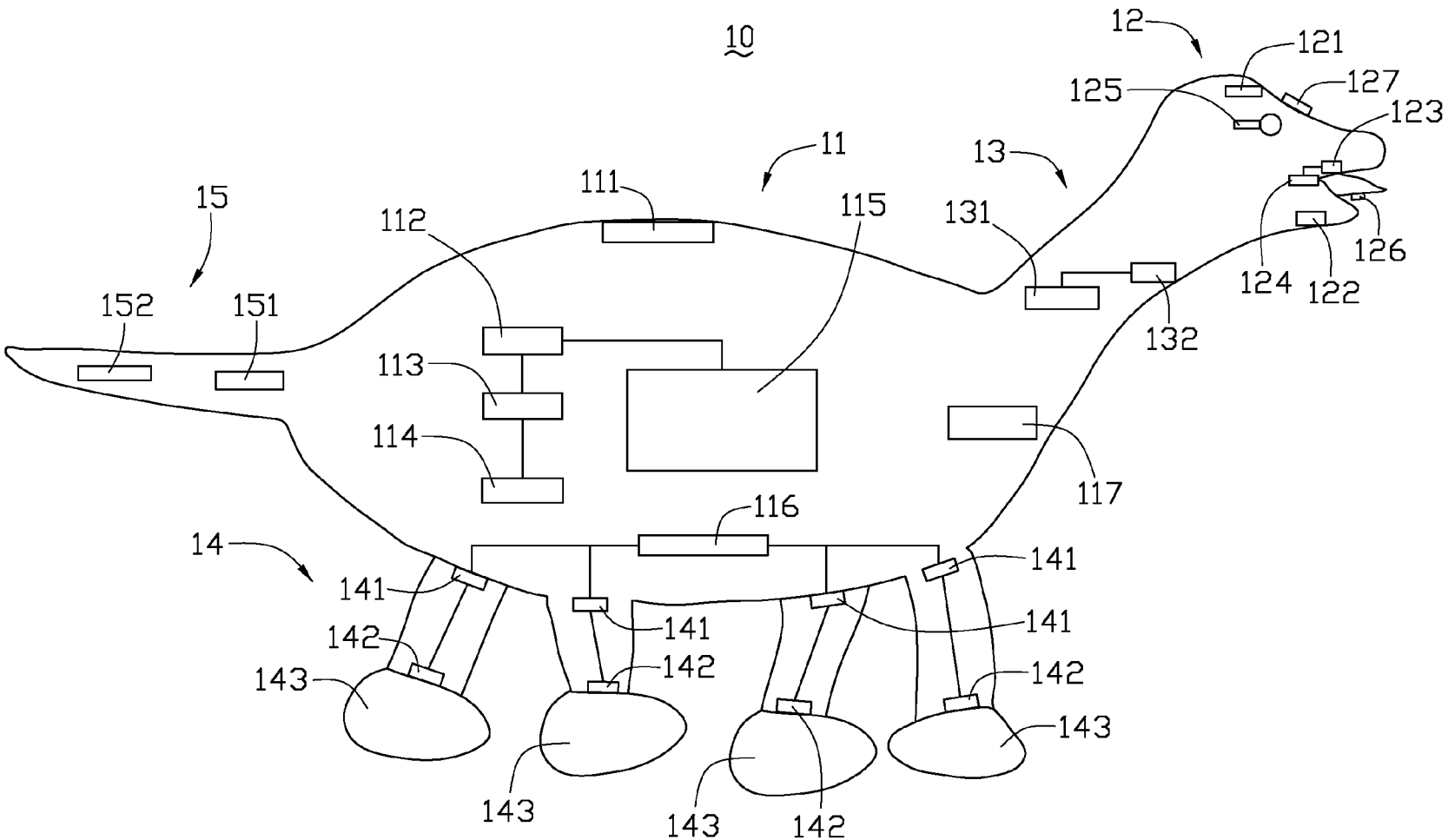
10
11
12
13
14
15
111
112
113
114
115
116
117
121
122
123
124
125
126
127
131
132
141
142
143
151
152

ELECTRONIC DINOSAUR TOY

BACKGROUND

1. Technical Field

The present invention relates to toys and, particularly to a dinosaur toy.

2. Discussion of Related Art

Generally, a popular kind of toy is designed in the shape of an animal, for example a dinosaur.

However, animal toys are usually limited in function and children quickly lose interest in the toy. As a result, the toys' ability to assist in the intellectual growth of children is limited.

Therefore, what is needed is an electronic toy with greater number of functions to maintain a child's interest.

SUMMARY

An electronic dinosaur toy, in accordance with a present embodiment, is provided. The electronic dinosaur toy includes a body, a neck, four legs, a tail, a head, four first actuators, and four pressure sensors. The neck, the legs and the tail are connected to the body. The head is connected to the distal end of the neck. The four first actuators are arranged inside the respective legs and configured for driving the corresponding leg to move. The four pressure sensors are arranged at distal ends of the respective legs, and configured for sensing variations in pressure applied to the leg and outputting a feedback signal. Thereby, the first actuators adjust movements and/or positions of the legs based on the feedback signal.

Detailed features of the present electronic dinosaur toy will become more apparent from the following detailed description and claims, and the accompanying drawings.

BRIEF DESCRIPTION OF THE DRAWINGS

Many aspects of the present electronic dinosaur toy can be better understood with reference to the following drawing. The components in the drawings are not necessarily drawn to scale, the emphasis instead being placed upon clearly illustrating the principles of the present electronic dinosaur toy. Moreover, in the drawing, like reference numerals designate corresponding parts throughout the whole view, wherein:

The drawing is a schematic view of an electronic dinosaur toy, according to an exemplary embodiment.

DETAILED DESCRIPTION OF THE PREFERRED EMBODIMENTS

Reference will now be made to the drawing to describe the embodiments of the present electronic dinosaur toy, in detail.

In the drawing, an electronic dinosaur toy 10, according to an exemplary embodiment, is provided. The electronic dinosaur toy 10 maybe designed to simulate any other kind of creature, real or imagined, and is built large enough and with strong enough materials to accommodate a child riding thereon. The electronic dinosaur toy 10 includes a body 11, a head 12, a neck 13, four legs 14, and a tail 15. The neck 13, the four legs 14, and the tail 15 are respectively connected to the body 11. The head 12 is connected to the distal end of the neck 13.

The four legs 14 are configured for supporting the body 11, Each of the four legs 14 is equipped with a first actuator 141 and a pressure sensor 142. The first actuators 141 are arranged inside the legs 14 respectively and configured for driving the corresponding legs 14 to move. The first actuators 141 can be piezoelectric actuators or micro-electro-mechanical systems (MEMS) actuators. The pressure sensors 142 are arranged in distal ends of the legs 14 respectively and configured for sensing variations in pressure to any of the legs 14 and outputting feedback signals representative of those variations in response to a user's movements while riding the electronic dinosaur toy 10 or applying pressure by hand. The first actuators 141 are configured for controlling actions of the legs 14 based on the feedback signals. As such, when the user applies pressure to the electronic dinosaur toy 10, for example shills their body while on the electronic dinosaur toy 10, the movement of the electronic dinosaur toy 10 will be adjusted according to the variation of the pressure felt by the pressure sensors 142. For example, when the user mounts the electronic dinosaur toy 10, which is standing upright on a solid relatively level surface, pressure on the legs 14 will increase and he sensed by the pressure sensors 142. Then, the pressure sensors 142 will output a feedback signal, corresponding to the increase in pressure, that causes the first actuators 141 to drive the legs 14 of the electronic dinosaur toy 10 to move in a way that simulates walking and causes the electronic dinosaur toy 10 to move forward at a certain speed. As the electronic dinosaur toy 10 moves, the average magnitude of pressure on the legs 14 remains relatively stable and so, correspondingly. movement of the electronic dinosaur toy 10 remains steady. Different speeds of the electronic dinosaur toy 10 can be obtained by, for example, the user shifting their position, such as leaning forward or leaning back, which then causes pressure on the legs 14 to shift. When the user leans forward, the electronic dinosaur toy 10 can respond with an increase in speed; and when the user leans back, the electronic dinosaur toy 10 can slow down. The electronic dinosaur toy 10 further includes four shoes 143 covering the respective pressure sensors 142.

The electronic dinosaur toy 10 can have additional functional modules as described as below.

The body 11 has a vibrator 111, a multimedia player 112, a storage device 113, a game machine 114, a display device 115, a temperature sensor 116, and a power supply 117 arranged therein. The vibrator 111 is configured for generating a vibration when the user is riding the electronic dinosaur toy 10, to simulate a more life-like feeling. The multimedia player 112 is configured for playing Mp3, Mp4 files and the like. The storage device 113 is configured for storing multimedia files that can be played by the multimedia player 112. The game machine 114 includes a loud speaker (not shown). The loud speaker is configured for generating different sounds when the user wins or loses a game. The display device 115 is arranged at an exterior of the body 11 and configured for displaying information such as images output by the multimedia player 112 and the game machine 114. The temperature sensor 116 is configured for sensing ambient environmental temperature and outputting a feedback signal representative of the ambient environmental to the first actuators 141. Thereby, sensitivity of the first actuators 141 may be adjusted to accomplish different sensitivity in differing temperature environments. The power supply 117 is configured for providing electric power to the electronic dinosaur toy 10.

The head 12 is equipped with a face, a forehead, eyeballs, a mouth, a tongue arranged in the mouth, and a chin. The head 12 has an optical imaging device 121, a second actuator 122, a sensing device 123, a third actuator 124, a voice coil motor 125, a sound generating device 126 and a voice identification device 127 arranged thereon. The optical imaging device 121 is arranged on the forehead and configured for picking up an external image and sending the image to the display device 115 for display. The second actuator 122 and the sensing device 123 are arranged in the chin. The second actuator 122 is configured for driving the chin to move up and down. The sensing device 123 is configured for sensing a location of the chin and outputting a feedback signal representative of the location to the second actuator 122. Thereby, the second actuator 122 actuates the chin to move based on the feedback signal. The sensing device 123 can be a positioning sensor, for example a capacitance type position sensor. The third actuator 124 is arranged in the mouth of the head 12 for driving the tongue to move back and forth. The third actuator 124 can be an electro-active polymer actuator. As such, when different voltages are applied to the electro-active polymer actuator, the tongue is actuated to move back and forth. The voice coil motor 125 is configured for driving the eyeballs to (for example) pop in and/or pop out. The sound generating device 126 is arranged in the mouth of the head 12 and configured for generating simulated dinosaur sounds. The voice identification device 127 is arranged on the face of the head 12 and configured for receiving voice of a user and identifying an identity of the user.

The neck 13 has a fourth actuator 131 and a first motion sensor 132 arranged therein. The fourth actuator 131 is configured for driving the neck 13 to swing. The first motion sensor 132 is configured for sensing a motion state for example slanting or accelerating, of the neck 13 and outputting a feedback signal representative of the motion state to the fourth actuator 131. Thereafter the fourth actuator 131 adjusts a movement of the neck 13 based on the feedback signal. The first motion sensor can be a three-axis accelerometer or a three-gyroscope sensor.

The tail 15 has a fifth actuator 151 and a second motion sensor 152 arranged therein. The fifth actuator 151 is configured for driving the tail 15 to move for example bending, shrinking, extending and/or slanting and so on. The second motion sensor 152 is configured for sensing a motion state of the tail 15 and outputting a feedback signal representative of the motion state to the fifth actuator 151. Thereby the fifth actuator 151 adjusts a movement of the tail 15 based on the feedback signal.

In sum, the electronic dinosaur toy 10 is equipped with many different actuators and pressure sensors, which can cooperatively simulate a creatures movement and sounds, and can even transport a rider. Further, the dinosaur 10 can be equipped with entertaining and/or educational audio and video files for keeping a child's interest for a much longer time than standard animal-like toys.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. An electronic dinosaur toy, comprising:

a body, a neck, four legs, a tail; the neck, the legs and the tail being connected to the body;

a head connected to a distal end of the neck, the head comprising a chin having a chin actuator and a sensing device arranged therein, the chin actuator and the sensing device being electrically connected to each other without any intervening electronic device therebetween, the chin actuator being configured for driving the chin to move, the sensing device being configured for sensing a location of the chin and outputting a feedback signal representative of the location to the chin actuator, the chin actuator being configured for driving the chin to move based on the feedback signal; and four first actuators arranged inside the respective legs, the first actuators being configured for driving the corresponding leg to move; and four pressure sensors arranged at distal ends of the respective legs, each pressure sensor being electrically connected to a corresponding first actuator without any intervening electronic device therebetween, the pressure sensors being configured for sensing a variation of a pressure applied to the leg and outputting a feedback signal, the first actuators being configured for adjusting movements and/or positions of the legs based on the feedback signal.

2. The electronic dinosaur toy according to claim 1, further comprising four shoes covering the respective pressure sensors.

3. The electronic dinosaur toy according to claim 1, wherein the head comprises a forehead having an optical imaging device for capturing an image.

4. The electronic dinosaur toy according to claim 1, wherein the head comprises a mouth having a tongue and a third actuator, the third actuator being arranged in the mouth and configured for driving the tongue to move back and forth.

5. The electronic dinosaur toy according to claim 4, wherein the mouth further comprises a sound generating device arranged therein, the sound generating device being configured for generating simulated dinosaur sound.

6. The electronic dinosaur toy according to claim 1, wherein the head comprises eyeballs and a voice coil motor configured for driving the eyeballs to pop in and/or pop out.

7. The electronic dinosaur toy according to claim 1, wherein the head comprises a face having a voice identification device arranged thereon, the voice identity device being configured for receiving voice of a user and identifying an identity of the user.

8. The electronic dinosaur toy according to claim 1, wherein the neck has a fourth actuator and a first motion sensor arranged therein, the fourth actuator being configured for driving the neck to swing, the first motion sensor being configured for sensing a motion state of the neck and outputting a feedback signal representative of the motion state to the fourth actuator, the fourth actuator being configured for adjusting a movement of the neck based on the feedback signal.

9. The electronic dinosaur toy according to claim 1, wherein the body has a vibrator arranged therein, the vibrator being configured for generating a vibration when a user is riding the electronic dinosaur toy.

10. The electronic dinosaur toy according to claim 1, wherein the body has a multimedia player arranged therein.

11. The electronic dinosaur toy according to claim 1, wherein the body has a game machine arranged therein, the game machine having a loudspeaker for generating different sounds when the user wins or loses a game.

12. The electronic dinosaur toy according to claim 1, wherein the body has a temperature sensor arranged therein, the temperature sensor being configured for sensing ambient environmental temperature and outputting a feedback signal representative of the ambient environmental temperature to the first actuators.

13. The electronic dinosaur toy according to claim 1, wherein the tail has a fifth actuator and a second motion sensor arranged therein, the fifth actuator being configured for driving the tail to move; and the second motion sensor being configured for sensing a motion state of the tail and outputting a feedback signal representative of the motion state to the fifth actuator, the fifth actuator being further configured for adjusting a movement of the tail based on the feedback signal.

* * * * *